US009579909B2

(12) United States Patent
Asada et al.

(10) Patent No.: US 9,579,909 B2
(45) Date of Patent: Feb. 28, 2017

(54) IMAGE RECORDING DEVICE

(71) Applicants: Tetsuo Asada, Kuwana (JP); Satoru Nakakita, Nagoya (JP)

(72) Inventors: Tetsuo Asada, Kuwana (JP); Satoru Nakakita, Nagoya (JP)

(73) Assignee: Brother Kogyo Kabushiki Kaisha, Nagoya-shi, Aichi-ken (JP)

( * ) Notice: Subject to any disclaimer, the term of this patent is extended or adjusted under 35 U.S.C. 154(b) by 0 days.

(21) Appl. No.: 14/262,396

(22) Filed: Apr. 25, 2014

(65) Prior Publication Data

US 2014/0232769 A1 Aug. 21, 2014

Related U.S. Application Data

(63) Continuation of application No. 13/238,834, filed on Sep. 21, 2011, now Pat. No. 8,721,066.

(30) Foreign Application Priority Data

Sep. 21, 2010 (JP) ..... 2010-210795

(51) Int. Cl.
*B41J 2/165* (2006.01)
*B41J 13/14* (2006.01)
*B41J 3/407* (2006.01)

(52) U.S. Cl.
CPC ..... *B41J 13/14* (2013.01); *B41J 3/4071* (2013.01)

(58) Field of Classification Search
None
See application file for complete search history.

(56) References Cited

U.S. PATENT DOCUMENTS 6,945,714 B2 9/2005 Miyauchi et al.
6,988,838 B2 * 1/2006 Inokuchi ..... B41J 3/4071 347/104
2004/0036756 A1 * 2/2004 Nakano ..... B41J 3/4071 347/104
2006/0181566 A1 8/2006 Miyashita et al.

FOREIGN PATENT DOCUMENTS

JP 2004-082654 A 3/2004
JP 2006-088654 A 4/2006
JP 2007-182316 A 7/2007

* cited by examiner

*Primary Examiner* — Alejandro Valencia
(74) *Attorney, Agent, or Firm* — Baker Botts L.L.P.

(57) ABSTRACT

An image recording device includes a recording unit, a feeding mechanism, a guide member, and a lock portion. The feeding mechanism is configured to feed a first feeding object along a feeding path. The feeding path has a straight path and a curved path. The recording unit faces the straight path. The guide member defines the curved path and is rotatable between an exposed position and a closed position. The lock portion is movable between a locked position at which the guide member is locked in the closed position and an unlocked position at which the lock is released. The guide member has a recess formed therein and the feeding mechanism further feeds a second feeding object to the recess along the straight path. When the second feeding object is disposed in the recess, the lock portion is disposed at the locked position.

16 Claims, 8 Drawing Sheets

IMAGE RECORDING DEVICE

CROSS REFERENCE TO RELATED APPLICATION

The present application is a continuation of U.S. patent application Ser. No. 13/238,834, which was filed on Sep. 21, 2011, which claims priority from Japanese Patent Application No. 2010-210795, which was filed on Sep. 21, 2010, the disclosures of which are incorporated herein by reference in their entirety.

BACKGROUND

1. Field of the Invention

The present invention relates to an image recording device which includes a cover having a recess formed therein, into which a feeding object is fed.

2. Description of the Related Art

An image recording device capable of recording an image on a recording medium, such as a CD, is known. In the image recording device, a cover having a hole, through which a tray on which the CD is placed can pass through, is provided at a rear surface of the image recording device. When the cover is abruptly opened while the tray is passing through the hole during the image recording on the recording medium, the tray or the recording medium may be damaged.

SUMMARY

A need has arisen to provide an image recording device capable of locking the cover while a feeding object is passing into or through the recess.

According to an embodiment of the present invention, an image recording device comprises a recording unit, a feeding mechanism, a guide member, and a lock portion. The feeding mechanism is configured to feed a first feeding object along a feeding path. The feeding path comprises a straight path and a curved path, and the recording unit faces the straight path. The guide member defines the curved path and rotates between an exposed position at which the curved path is exposed to an exterior of the image recording device and a closed position at which the curved path is covered with respect to the exterior of the image recording device. The lock portion moves between a locked position at which the guide member is locked in the closed position and an unlocked position at which the lock is released. The guide member has a recess formed therein, and the feeding mechanism is further configured to feed a second feeding object into the recess along the straight path. The second feeding object is disposed in the recess and prevents the lock portion from moving to the unlocked position.

According to another embodiment of the present invention, an image recording device comprises a housing, a recording unit, a feeding unit, a cover, a locking lever, and a blocking portion. The housing comprises an engaged portion, and the feeding unit is configured to feed a tray along a feeding path. The cover is configured to be pivotable. The locking lever is configured to lock the cover on the housing and comprising an engaging portion configured to engage with the engaged portion. The blocking portion moves into the feeding path, and the feeding unit is configured to feed the tray to a determined position, such that the tray blocks the blocking portion from moving into the feeding path.

According to still another embodiment of the present invention, an image recording device comprises a housing, a recording unit, means for feeding a tray, a pivotable cover, a movable locking lever, and means for blocking the locking lever. The means for feeding feeds the tray along a feeding path, and the movable locking lever configured to lock the pivotable cover on the housing. The means for blocking blocks the locking lever from moving when a recording medium is in a predetermined position, such that the tray blocks the means for blocking from moving into the feeding path.

Other objects, features, and advantages of the present invention are apparent to persons of ordinary skill in the art in view of the following detailed description of the invention and the accompanying drawings.

DESCRIPTION OF PREFERRED EMBODIMENTS

Figure 1:
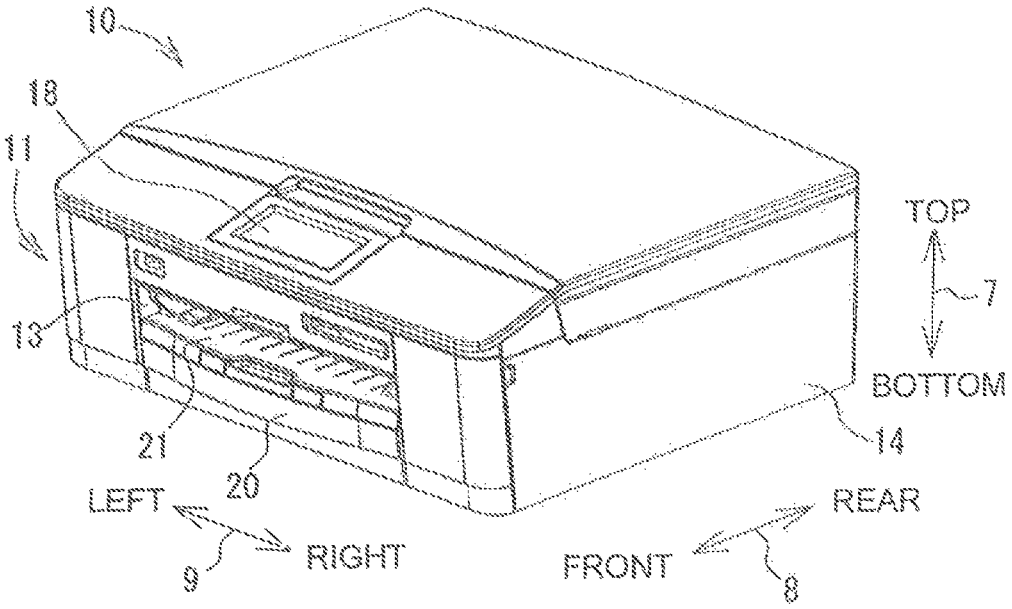
FIG. 1 is an exterior perspective view of a multi-function device which is an example of an embodiment of the present invention.

Hereinafter, an embodiment of the present invention will be described. It should be understood that the embodiment of the present invention described below is illustrative only and modifications may be made thereto without departing from the spirit and scope of the present invention. In the following description, a vertical direction 7 is defined with reference to a state in which a multi-function device 10 is installed usable (i.e., a state illustrated in FIG. 1); a front-rear direction 8 is defined with the side on which a front opening 13 is provided being a front side; and a left-right direction 9 is defined as the multi-function device 10 being seen from the front side.

[Multi-Function Device 10]

As illustrated in FIG. 1, the multi-function device 10 (an example of an image recording device) is formed as a substantially thin box. An ink-jet printer section 11 is provided in a lower portion of the multi-function device 10. The multi-function device 10 has various functions, including a facsimile function and a print function. The multi-function device 10 only with a one-side image recording function as a print function is described in the present embodiment; but the multi-function device 10 may be with a double-sided image recording function. The printer section 11 includes a housing 14 which is provided with a front opening 13 on the front side thereof. A paper feed tray 20 and an output tray 21 are provided to be inserted and drawn through the front opening 13 in the front-rear direction 8. Recording sheets (an example of a first feeding object) of a desired size are placed on the paper feed tray 20.

Figure 2:
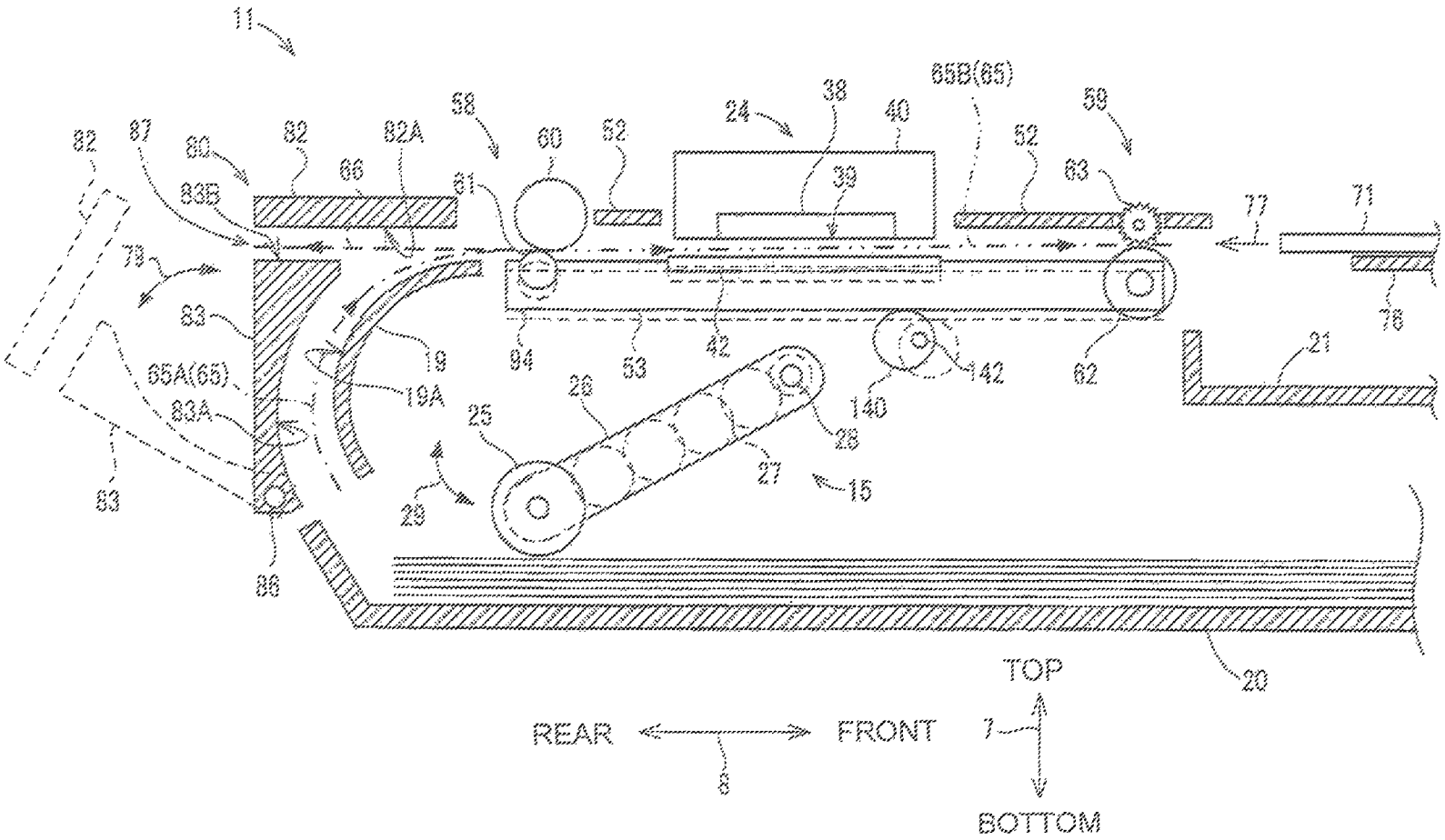
FIG. 2 is a longitudinal sectional view schematically illustrating an internal structure of a printer section.

As illustrated in FIG. 2, the printer section 11 includes a paper feeding unit 15 (an example of a feeding mechanism) for feeding recording sheets and an ink-jet recording unit 24 (an example of a recording unit) for recording images on the recording sheets. The printer section 11 records an image on a recording sheet in accordance with, for example, print data received from external devices. The multi-function device 10 has a function to record images by the recording unit 24 on a disc surface of a recording medium (an example of a second feeding object), such as a CD-ROM and a DVD-ROM which are thicker rather than the recording sheet. This function will be described later.

[Paper Feeding Unit 15]

The paper feeding unit 15 is provided above the paper feed tray 20. The paper feeding unit 15 is provided with a paper feed roller 25, a paper feed arm 26 and a drive transmission mechanism 27. The paper feed roller 25 is rotatably supported at a front end of the paper feed arm 26. the paper feed arm 26 pivots about a shaft 28 in the direction of arrow 29. This allows the paper feed roller 25 to be moved close to or away from the paper feed tray 20. The drive transmission mechanism 27 constituted by a plurality of gears meshing together transmits driving force from a paper feed motor (not illustrated) to rotate the paper feed roller 25. The paper feed roller 25 feeds the recording sheets placed on the paper feed tray 20 one at a time to a first path 65, which will be described later.

[First Path 65 and Second Path 66]

The first path 65 and a second path 66 are formed inside the printer section 11. The first path 65 extends from a leading end (i.e., a rear end) of the paper feed tray 20 to reach the output tray 21 via the recording unit 24. A media tray 71 (an example of a second feeding object), which will be described later, capable of carrying a recording sheet and a recording medium can be guided along the first path 65 (an example of a feeding path). The second path 66 branches from the first path 65 and reaches a rear end of the printer section 11. The media tray 71 can be guided along the second path 66.

The first path 65 is constituted by a curved path 65A and a straight path 65B. The curved path 65A extends from the leading end of the paper feed tray 20 to reach a first roller pair 58 which will described later. The straight path 65B extends from the recording unit 24 to reach the output tray 21. That is, the curved path 65A and the straight path 65B are formed in the first path 65.

The curved path 65A is a curved path extending from near the leading end of the paper feed tray 20 to reach the first roller pair 58 (an example of a feeding mechanism). The recording sheet is conveyed on the curved path 65A in a conveying direction (i.e., a direction illustrated by a dash-dot line in FIG. 2) and is curved in the conveying direction (i.e., the direction illustrated by an arrow on the dash-dot line in FIG. 2). The curved path 65A continues the straight path 65B at the first roller pair 58. This allows the recording sheet to be guided to the straight path 65B via the curved path 65A. The curved path 65A is defined by an inner guide member 19 and a lower member 83 of a cover member 80 (an example of a guide member), which will be described later. The inner guide member 19 and the lower member 83 oppose each other at a predetermined distance. That is, an inner side of the curved path 65A is defined by an inner guide surface 19A which constitutes a rear surface of the inner guide member 19 and an outer side of the curved path 65A is defined by an outer guide surface 83A which constitutes a front surface of the lower member 83.

The straight path 65B is a straight path extending from the conveying direction downstream end of the curved path 65A, i.e., at a position of the first roller pair 58 to reach the output tray 21 along the front-rear direction 8. The recording sheet is guided along the straight path 65B in the conveying direction (i.e., the direction of arrow on a dash-dot-dot line in FIG. 2). That is, the recording sheet is guided linearly along the straight path 65B. After an image is recorded thereon by the recording unit 24, the recording sheet is output on the output tray 21. The media tray 71 is guided in both the conveying direction and a direction opposite to the conveying direction along the straight path 65B. The straight path 65B is constituted by an upper guide member 52 and a platen support member 53 supports a platen 42 which will be described later. The upper guide member 52 and the platen support member 53 oppose each other at a predetermined distance.

The second path 66 is a straight path formed in the cover member 80. When the cover member 80 is in its closed position (i.e., in a state illustrated by a solid line in FIG. 2), the second path 66 extends toward the rear surface of the multi-function device 10 in a direction opposite to the straight path 65B extending forward from the first roller pair 58, i.e., the second path 66 extends rearward. That is, when the cover member 80 is in its closed position, the second path 66 and the straight path 65B are continued at the first roller pair 58 to constitute a single continuous straight path. When the cover member 80 is in its closed position, the media tray 71 is guided in the conveying direction and the direction opposite thereto (i.e., the direction illustrated by a dashed line with an arrow in FIG. 2) on the second path 66. The second path 66 is defined by an upper member 82 and a lower member 83 of the cover member 80 which oppose each other at a predetermined distance. That is, the second path 66 is defined by an upper guide surface 82A which constitutes a lower surface of the upper member 82 and a lower guide surface 83B which constitutes an upper surface of the lower member 83.

[Recording Unit 24]

The recording unit 24 is provided above the straight path 65B. The recording unit 24 is provided with a carriage 40 which reciprocates in a main scanning direction (i.e., a direction vertical to the page of FIG. 2) with a recording head 38 mounted thereon. Ink is supplied to the recording head 38 from an ink cartridge (not illustrated). The recording head 38 ejects ink as minute ink droplets through a nozzle 39. As the carriage 40 reciprocates in the main scanning direction, the recording head 38 is made to scan the recording sheet and an image is recorded on the recording sheet which is conveyed on the platen 42. The platen 42 is provided below the straight path 65B to oppose the recording unit 24. The platen 42 supports the recording sheet and is supported by the platen support member 53. The recording unit 24 can record an image also on a disc surface of a recording medium as will be describe later.

[First Roller Pair 58 and Second Roller Pair 59]

The first roller pair 58 is provided in the upstream of the recording unit 24 along the conveying direction. The first roller pair 58 is constituted by a first conveyance roller 60 disposed above the first path 65 and the second path 66 and a pinch roller 61 disposed below the first path 65 and the second path 66 to oppose the first conveyance roller 60. The pinch roller 61 is pressed against a roller surface of the first conveyance roller 60 by an elastic member, such as a spring (not illustrated). The first roller pair 58 holds the recording sheet and sends the same to the platen 42. The first roller pair 58 holds the media tray 71 and conveys the same rearward or forward.

A second roller pair 59 (an example of a feeding mechanism) is provided in the downstream of the recording unit 24 along the conveying direction. The second roller pair 59 is constituted by a second conveyance roller 62 disposed below the first path 65 and a spur 63 disposed above the first path 65 to oppose the second conveyance roller 62. The spur 63 is pressed against a roller surface of the second conveyance roller 62 by an elastic member, such as a spring (not illustrated). The second roller pair 59 holds the recording sheet which has passed the recording unit 24 and conveys the same to the output tray 21. The second roller pair 59 holds the media tray 71 and conveys the same rearward or forward.

The first conveyance roller 60 and the second conveyance roller 62 are rotated by rotation driving force transmitted from a conveyance motor (not illustrated) via a drive transmission mechanism (not illustrated). The drive transmission mechanism is constituted by, for example, a planet gear and causes the rollers 60 and 62 to rotate such that the recording sheet or the media tray 71 is conveyed in the conveying direction when the conveyance motor is rotated in one of the forward and rearward conveying directions (forward direction herein) and the media tray 71 is conveyed in the direction opposite to the conveying direction when the conveyance motor is rotated in the other of the forward and rearward conveying directions (rearward direction herein).

[First Roller Pair 58, Second Roller Pair 59 and Change Positions of Platen 42]

Positions of the rollers of the first roller pair 58 can be changed between a contact position in which they are in contact with each other and a separate position in which they are separated from each other. Similarly, positions of the rollers of the second roller pair 59 can be changed between the contact position and the separate position. When the first roller pair 58 and the second roller pair 59 are in their contact positions, the recording sheet can be held between the rollers and is conveyed along the straight path 65B. When, on the other hand, the first roller pair 58 and the second roller pair 59 are in their separate positions, gaps between the rollers of each of the roller pairs are suited for holding the media tray 71 and the first roller pair 58 and the second roller pair 59 convey the media tray 71 along the straight path 65B and the second path 66. In the present embodiment, as the pinch rollers 61 and the second conveyance roller 62 are moved downward, the position of the first roller pair 58 and the second roller pair 59 is changed from the contact position to the separate position.

The platen 42 can also be moved downward. If the platen 42 has not been moved downward, a gap between the platen 42 and the recording unit 24 is suited for the recording sheet to pass below the recording unit 24. If, on the other hand, the platen 42 has been moved downward, the gap is suited for the media tray 71 to pass below the recording unit 24.

Downward movement of the pinch rollers 61, the second conveyance roller 62 and the platen 42 is performed by, for example, an eccentric cam 140 and the platen support member 53 disposed below the pinch rollers 61, the second conveyance roller 62 and the platen 42. The eccentric cam 140 is supported by a frame (not illustrated) to be rotatable about the left-right direction 9. The frame constitutes the housing 14 of the multi-function device 10. The eccentric cam 140 is a disc of which diameter from a shaft 142 varies periodically.

The platen support member 53 is placed on and supported by the eccentric cam 140. The pinch rollers 61 and the second conveyance roller 62 are rotatably supported by the platen support member 53. The platen 42 is supported by the platen support member 53 as described above.

In the present embodiment, the eccentric cam 140 is driven to rotate by a motor which is not illustrated. When the eccentric cam 140 is rotated, a peripheral surface of the eccentric cam 140 is slid against the platen support member 53. Since the eccentric cam 140 has a periodically varying diameter from the shaft 142, such variation in diameter causes the peripheral surface of the eccentric cam 140 to move the platen support member 53 in the vertical direction 7. As the platen support member 53 is moved in the vertical direction 7, the pinch rollers 61, the second conveyance roller 62 and the platen 42 are moved in the vertical direction 7. In FIG. 2, a state in which the platen support member 53 has been moved upward is illustrated by a solid line and a state in which the platen support member 53 has been moved downward is illustrated by a dashed line.

[Media Tray 71]

As described above, the multi-function device 10 has a function to record an image on a disc surface of a recording medium. When an image is to be recorded on a disc surface of a recording medium, the recording medium is placed on the media tray 71.

Figure 3A:
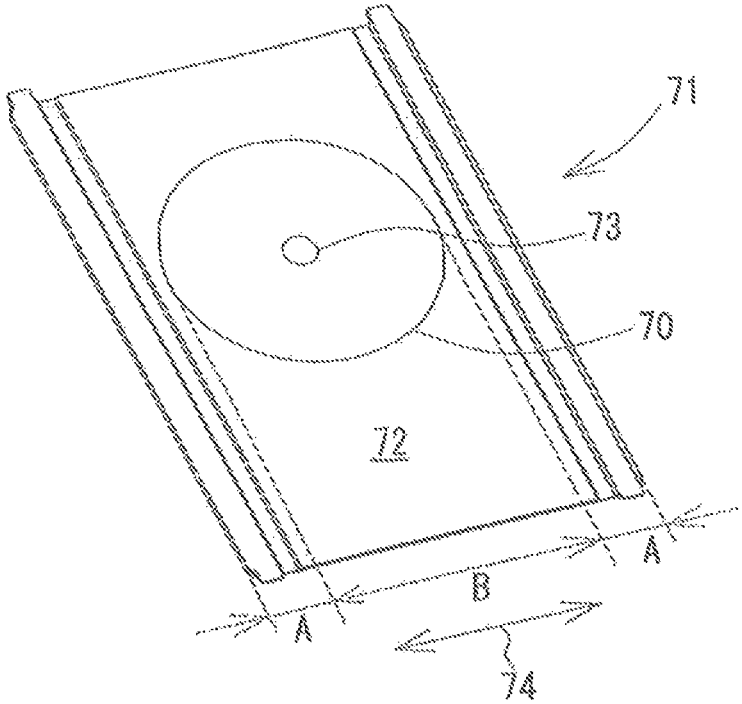
FIG. 3A is an exterior perspective view of a media tray seen from an upper surface side.
Figure 3B:
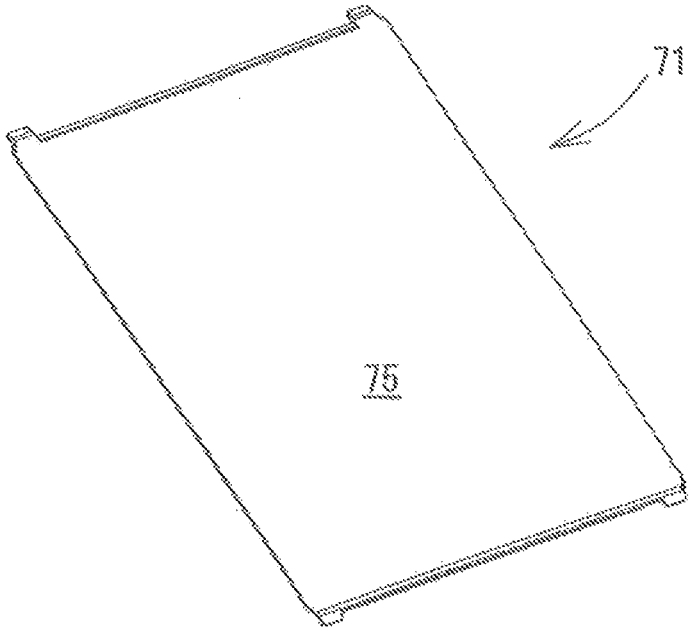
FIG. 3B is an exterior perspective view of the media tray seen from a lower surface side.

As illustrated in FIGS. 3A and 3B, the media tray 71 is a thin box-shaped resin plate. A media carrier portion 70 on which the recording medium is placed is provided on an upper surface 72 of the media tray 71. The media carrier portion 70 is a circular recess. The diameter of the recess is the same as or slightly larger than the diameter of the recording media (e.g., a circular CD-ROM and a DVD-ROM) to be placed on the recess. A circular projection 73 is provided at the center of the recess. A circular CD-ROM and a DVD-ROM usually have a circular hole at the central portion. The projection 73 is substantially the same in size as the diameter of the hole and is made to fit into the hole. With this, the recording medium is not moved in the front-rear direction 8 and the left-right direction 9 when the recording medium is placed on the media carrier portion 70.

The depth of the media carrier portion 70 is greater than the thickness of the recording medium. With this, the upper surface of the recording medium placed on the media carrier portion 70 does not protrude from the upper surface 72 of the media tray 71.

Figure 5A:
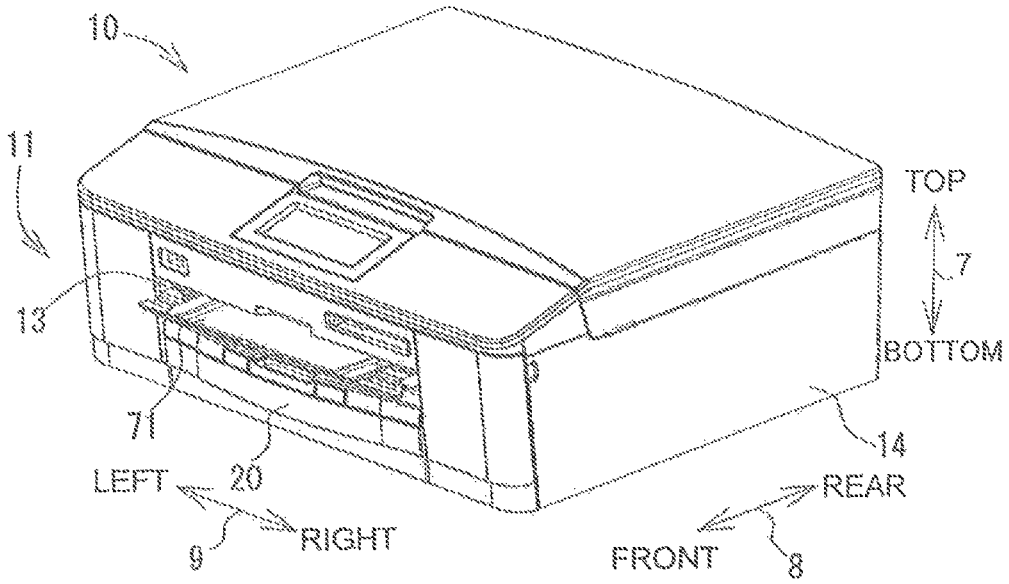
FIG. 5A is an exterior perspective view of the multi-function device, illustrating a state in which the media tray is inserted from a front opening.
Figure 5B:
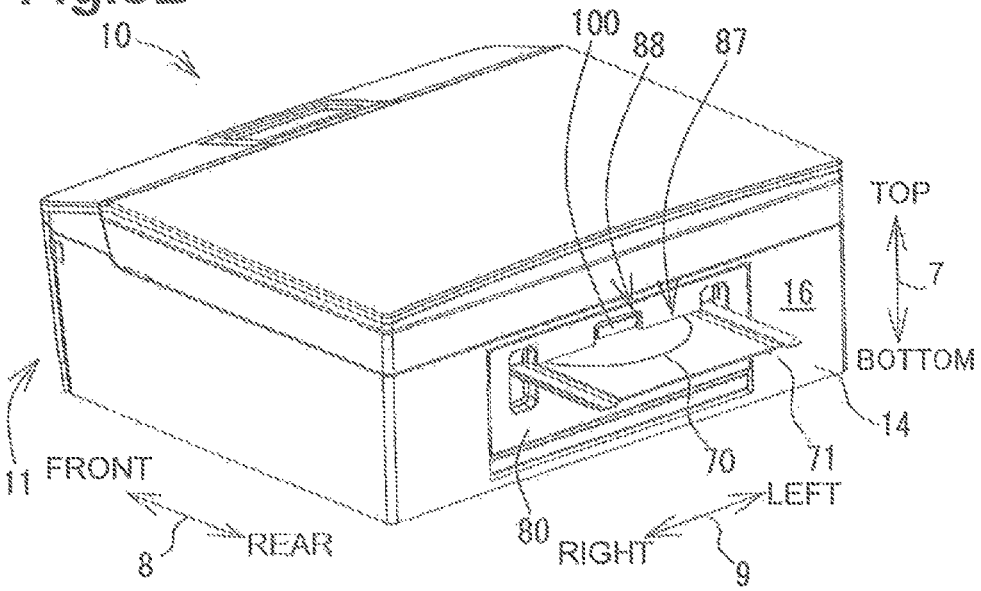
FIG. 5B is an exterior perspective view of the multi-function device, illustrating a state in which the media tray protrudes from a through hole.

As illustrated in FIGS. 2, 5A and 5B, the media tray 71, which is placed on a tray guide 76 with the upper surface 72 facing upward, is inserted in the front opening 13 along the straight path 65B in the direction of arrow 77 that is opposite to the conveying direction.

[Cover Member 80]

Figure 4A:
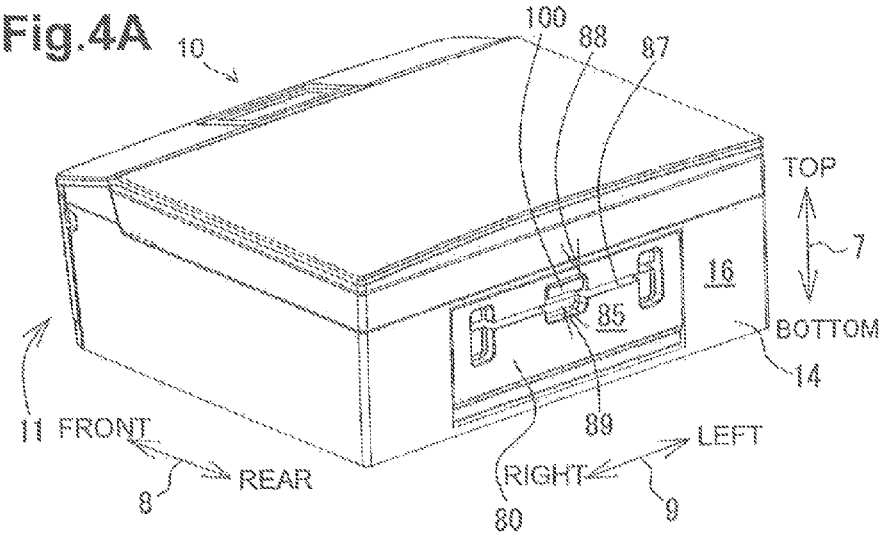
FIG. 4A is an exterior perspective view of the multi-function device seen from a rear surface side, illustrating a cover member at a closed position.
Figure 4B:
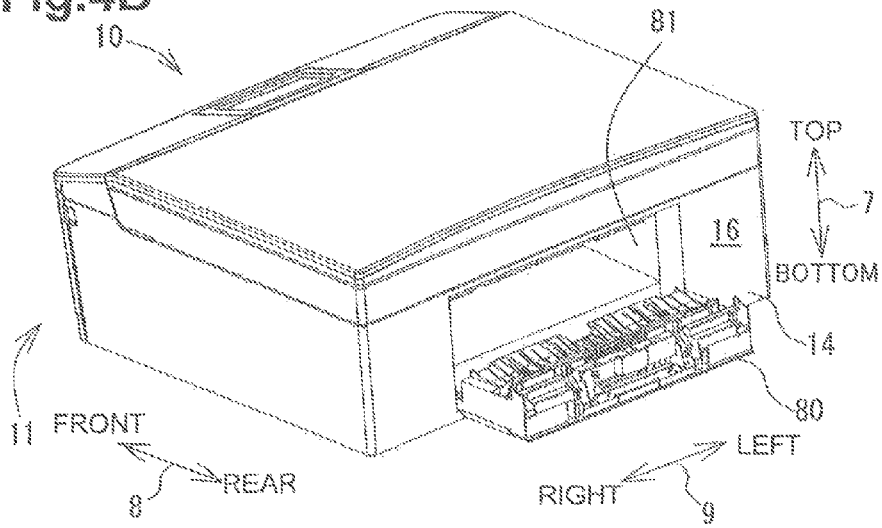
FIG. 4B is an exterior perspective view of the multi-function device seen from a rear surface side, illustrating the cover member at an exposed position.

As illustrated in FIGS. 4A and 4B, the cover member 80 is attached to the rear surface 16 of the housing 14 of the multi-function device 10 opposing the front surface. In particular, a rear opening 81 is formed in the rear surface 16 at a position substantially corresponding to the front opening 13 as illustrated in FIG. 4B and the cover member 80 is attached to close the rear opening 81 as illustrated in FIG. 4A.

As illustrated in FIGS. 6 to 8C, the cover member 80 is provided with the upper member 82, the lower member 83 provided below the upper member 82, two side plates 84 and a rear plate 85. The two side plates 84 are provided at the right and left ends of the cover member 80. The upper member 82 and the lower member 83 are attached between the two side plates 84. The rear plate 85 is attached to the rear side of the upper member 82 and the lower member 83. A rear surface of the rear plate 85 is substantially rectangular in shape.

As illustrated in FIG. 2, the second path 66 is defined by the upper guide surface 82A which constitutes the lower surface of the upper member 82 and the lower guide surface 83B which constitutes the upper surface of the lower member 83. This means that the second path 66 is formed on the cover member 80 and the upper member 82 and the lower member 83 oppose each other across the second path 66. As described above, the curved path 65A is defined by the inner guide surface 19A which constitutes the rear surface of the inner guide member 19 and the outer guide surface 83A which constitutes the front surface of the lower member 83. This means that the outer guide surface 83A is formed on the cover member 80 and defines the outside of the curved path 65A.

As illustrated in FIGS. 2 and 6 to 7B, the cover member 80 is pivotable in the direction of arrow 79 about a shaft 86 extending in the left-right direction 9 (i.e., the vertical direction of the page of FIG. 2) near the lower end of the lower member 83. As illustrated in FIGS. 2, 4A and 4B, the position of the cover member 80 is changed between the closed position (i.e., the state illustrated by a solid line in FIG. 2 and the state illustrated in FIG. 4A) and the exposed position (i.e., the state illustrated by a dashed line in FIG. 2 and the state illustrated in FIG. 4B).

When the cover member 80 is in its closed position, the rear side of the curved path 65A is covered by the lower member 83 and thus the curved path 65A is shielded from the outside of the multi-function device 10. When, on the other hand, the cover member 80 is in its exposed position, the curved path 65A is exposed to the rear side of the multi-function device 10. When the cover member 80 is in its closed position, the outer guide surface 83A defines the curved path 65A and guides the recording sheet. When, on the other hand, the cover member 80 is in its exposed position, the outer guide surface 83A is inclined rearward and thus does not define the curved path 65A, whereby the recording sheet is not guided.

As described above, when the cover member 80 is in its closed position, the straight path 65B and the second path 66 constitute a single continuous straight path. Thus, when the cover member 80 is in its closed position, the media tray 71 can be guided along the straight path 65B and the second path 66.

As illustrated in FIGS. 2, 4A, and 7A to 8C, a through hole 87 (an example of a recess), having an opening, is formed in the rear plate 85 of the cover member 80. In particular, the through hole 87 is formed in the rear plate 85 at a position corresponding to a rear end of the second path 66. The through hole 87 is formed in the size such that the media tray 71 conveyed on the second path 66 can pass through the same.

In the present embodiment, the length of the left-right direction 9 of the through hole 87 is slightly longer than the length used as the left-right direction 9 when the media tray 71 is inserted in the multi-function device 10. The length of the vertical direction 7 of the through hole 87 is slightly longer than the length used as the vertical direction 7 when the media tray 71 is inserted in the multi-function device 10. With this, the media tray 71 which has been inserted in the front opening 13 in the direction of arrow 77 conveyed on the second path 66 via the straight path 65B can further be conveyed rearward than the rear surface 16 of the multi-function device 10 via the through hole 87 even after reaching the rear end of the second path 66. Here, the media tray 71 protrudes out of the multi-function device 10 from the through hole 87 as illustrated in FIG. 5B. That is, the media tray 71 guided along the straight path 65B and the second path 66 is made to protrude out of the multi-function device 10 from the through hole 87.

[Lock Portion 90]

As illustrated in FIGS. 6 and 8A to 8C, the lock portion 90 is attached to the upper member 82 of the cover member 80. The lock portion 90 is provided with a shaft 91 and two arms 92 which extend in the same direction near the both ends of the shaft 91. In the present embodiment, the lock portion 90 is provided with two arms 92, but the number of the arms 92 is not limited thereto. That is, the lock portion 90 may include a single arm 92 or three or more arms 92.

The lock portion 90 is fit into a recess formed on the upper surface of the upper member 82 such that the shaft 91 lies in the left-right direction 9 and the two arms 92 extend forward and, in particular, toward a lower front side from the shaft 91. Both ends of the shaft 91 are rotatably supported on a side surface of the recess. With this, when the shaft 91 is rotated, the two arms 92 are rotated in the direction of arrow 93 illustrated in FIG. 8A.

Figure 8A:
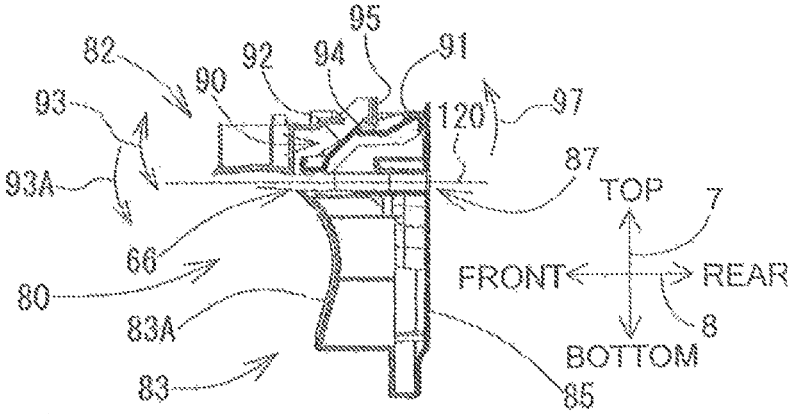
FIG. 8A is a longitudinal sectional view of the cover member, illustrating a state in which a lock portion is at a locked position.

A projection 94 is formed substantially intermediate between a base end and a free end of each of the two arms 92. The projection 94 is formed to protrude upward from each of the two arms 92 in a state in which the lock portion 90 is fit into the upper member 82. The projection 94 is engageable with a projection 95 protruding downward from a frame positioned to oppose the upper surface of the upper member 82 among frames which constitute the housing 14 of the multi-function device 10. As illustrated in FIG. 8A, when the cover member 80 is in its closed position, the projection 94 and the projection 95 engage each other with the projection 94 being on the front side and the projection 95 being on the rear side. With this, even if a user of the multi-function device 10 tries to change the positions of the cover member 80 from the closed position to the exposed position, the rearward movement of the projection 94 is inhibited by the projection 95 and thus a change in position of the cover member 80 is impossible unless a manipulation unit 100 which will be described later is manipulated.

[Manipulation Unit 100]

Figure 7A:
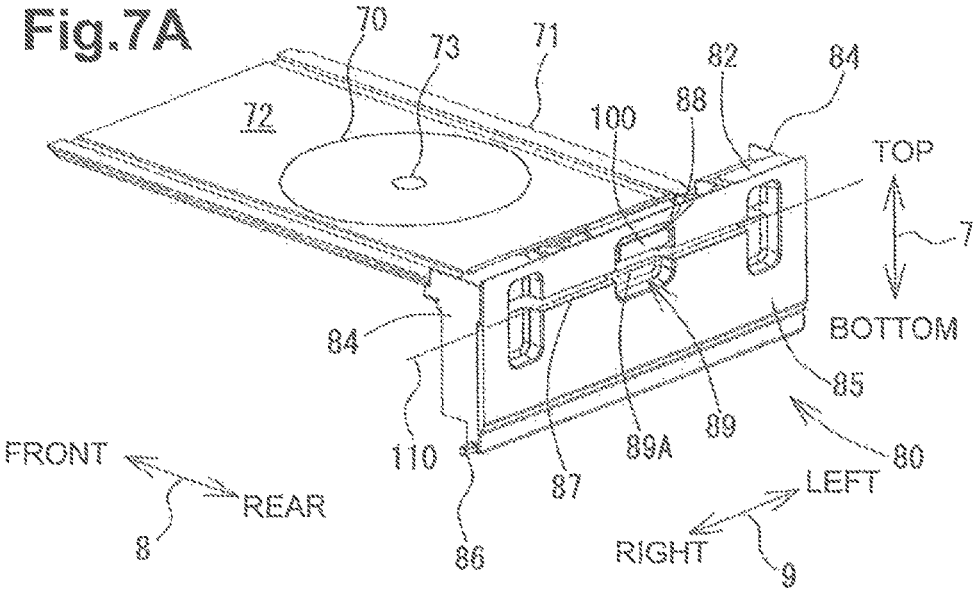
FIG. 7A is a perspective view of the cover member and the media tray, illustrating a state in which the media tray does not project from the through hole.
Figure 7B:
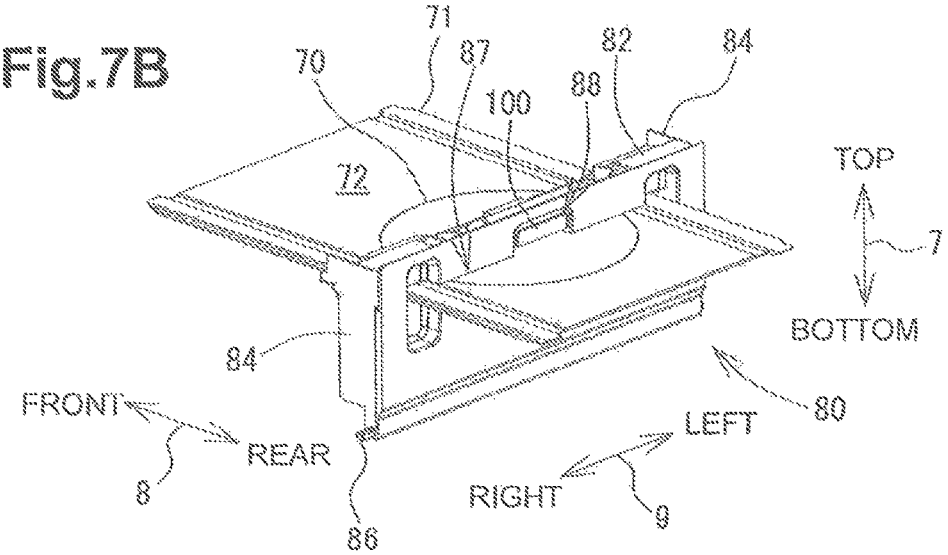
FIG. 7B is a perspective view of the cover member and the media tray, illustrating a state in which the media tray projects from the through hole.

The manipulation unit 100 (an example of a unlock portion) illustrated in FIGS. 7A and 7B is provided on the shaft 91 of the lock portion 90. The manipulation unit 100 may be integrated with the shaft 91 or may be attached to the shaft 91. The manipulation unit 100 is provided to protrude in a direction opposite to the two arms 92 from the center of the shaft 91. That is, the manipulation unit 100 is provided to protrude rearward from the shaft 91 in the state in which the lock portion 90 is fit into the upper member 82.

In the present embodiment, the through hole 87 defines a space 88 in the center of the left-right direction 9 at a position above the position corresponding to the second path 66 as illustrated in FIGS. 7A and 7B. This means that the length of the through hole 87 in the vertical direction 7 at the position at which the space 88 is defined is greater than the length of the through hole 87 in the vertical direction 7 at the position at which the space 88 is not defined. The manipulation unit 100 protruding rearward from the shaft 91 occupies a part of the space 88. With this, the manipulation unit 100 is visible from outside of the multi-function device 10. The user can manipulate the manipulation unit 100 by, for example, grasping the manipulation unit 100 via a space below the space 88, i.e., a space which constitutes the through hole 87, from outside of the multi-function device 10. That is, the space for the manipulation of the manipulation unit 100 is shared by the space which constitutes the through hole 87.

[Operation of Lock Portion 90]

Figure 8B:
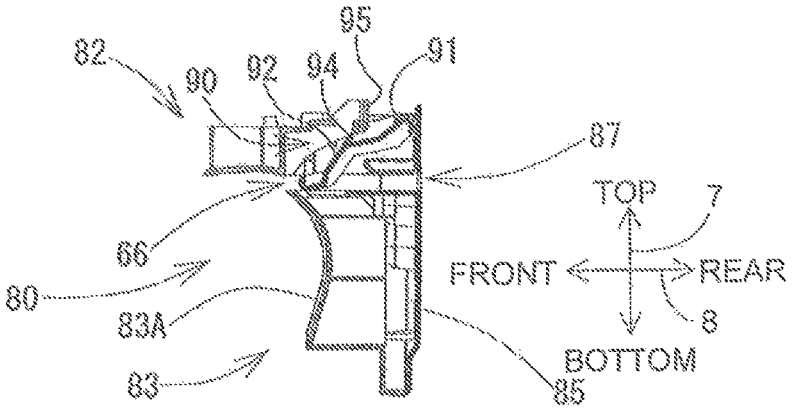
FIG. 8B is a longitudinal sectional view of the cover member, illustrating a state in which the lock portion is at an unlocked position.
Figure 8C:
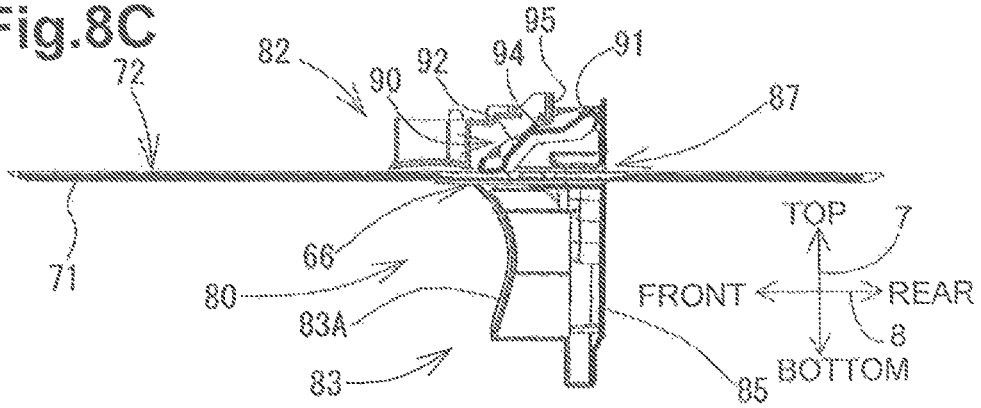
FIG. 8C is a longitudinal sectional view of the cover member, illustrating a state in which the lock portion is in contact with the media tray.

As illustrated in FIGS. 8A to 8C, the two arms 92 (an example of a pair of arms) of the lock portion 90 pivot in the direction of arrow 93 when the shaft 91 is rotated. Thus, positions of the lock portion 90 can be changed between a locked position (i.e., a position illustrated in FIG. 8A) in which the two arms 92 are positioned above the second path 66 and an unlocked position (i.e., a position illustrated in FIG. 8B) in which the two arms 92 are positioned in the space in which the two arms 92 constitute the second path 66.

Figure 6:
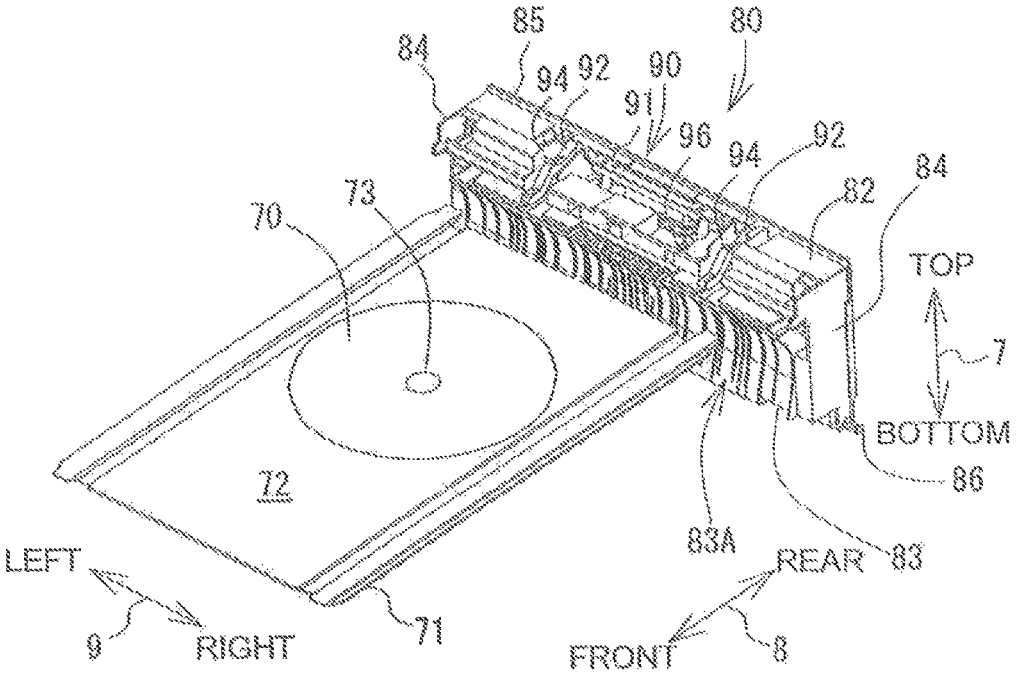
FIG. 6 is a perspective view of a cover member and the media tray guided along a first path.

As illustrated in FIG. 6, a coil spring 96 is attached to urge the lock portion 90 toward the locked position. In particular, one end of the coil spring 96 is attached to the front side of the shaft 91 in the locked position and the other end of the coil spring 96 is attached to the upper member 82 which opposes the one end on the front side. With this, when the position of the lock portion 90 is changed from the locked position to the unlocked position, the coil spring 96 is extended by the rotation of the shaft 91. At this time, the coil spring 96 produces elastic force in the contracting direction so as to urge the lock portion 90 toward the locked position.

As illustrated in FIG. 8A, the lock portion 90 is in the locked position when the cover member 80 is in the closed position. At this time, the lock portion 90 is located above the media tray 71 which is guided along the second path 66, and is located above the recording medium placed on the media tray 71. This means that, when in the locked position, the lock portion 90 is separated from the media tray 71 guided along the second path 66 and from the recording medium placed on the media tray 71. At this time, since the projection 94 engages the projection 95, a change in position of the cover member 80 is impossible. That is, the cover member 80 is locked by the closed position in the locked position.

When the user of the multi-function device 10 manipulates the manipulation unit 100 to move upward, i.e., in the direction of arrow 97, the two arms 92 pivot downward, i.e., in the direction of arrow 93A as illustrated in FIG. 8A. Then the lock portion 90 is moved to its unlocked position as illustrated in FIG. 8B. That is, the manipulation unit 100 is manipulated to change positions of the lock portion 90 from the locked position to the unlocked position.

As illustrated in FIG. 8B, when the lock portion 90 is in its unlocked position, the projection 94 is located below the projection 95 and thus does not engage the projection 95. This means that a rearward movement of the projection 94 is not inhibited by the projection 95. Thus, a pivotal movement, i.e., a change in position, of the cover member 80 is possible. That is, in the unlocked position, the lock of the cover member 80 is released.

When the lock portion 90 is in its unlocked position, the free ends of the two arms 92 are located in the space which constitutes the second path 66. That is, the space occupied by a part of the lock portion 90 in its unlocked position is shared by the space which constitutes the second path 66. With this, when the lock portion 90 is in its unlocked position, the media tray 71 cannot be guided along the second path 66.

That is, when the media tray 71 is guided along the second path 66, the lock portion 90 cannot be moved to the unlocked position. This is because, as illustrated in FIG. 8C, in the course of the change in position of the lock portion 90 from the locked position to the unlocked position, the free ends of the two arms 92 of the lock portion 90 are brought into contact with the upper surface 72 of the media tray 71 guided along the second path 66 or with the recording medium placed on the media carrier portion 70 and thereby a further downward pivotal movement of the two arms 92 is inhibited. As described above, as the media tray 71 and the lock portion 90 are in contact with each other, a change in position of the lock portion 90 to the unlocked position is controlled.

Although the configuration in which the free ends of the two arms 92 are located in the space which constitutes the second path 66 has been described in the present embodiment, the present invention is not limited to such a configuration as long as the space constituted by at least a part of the lock portion 90 in its unlocked position is shared by the space which constitutes the second path 66. For example, the entire two arms 92 may be located in the space which constitutes the second path 66 when the lock portion 90 is in its unlocked position.

The manipulation unit 100 is also manipulated to change positions of the lock portion 90 from the unlocked position to the locked position. In this case, for example, the user causes the cover member 80 to pivot to change positions thereof to the closed position while manipulating the manipulation unit 100 in the direction of arrow 97. Then, in the state in which the cover member 80 is in its closed position, the user removes his or her hand from the manipulation unit 100. Thus the position of the lock portion 90 is changed from the unlocked position to the locked position by the urging force of the coil spring 96.

[Image Recording on Storage Medium]

Hereinafter, a procedure in which the media tray 71 is inserted in the multi-function device 10 and an image is recorded on the recording medium placed on the media tray 71 will be described. When a function to record an image on the recording medium is selected by the manipulation of a manipulation panel 18 (see FIG. 1) provided in an upper front portion of the multi-function device 10, the eccentric cam 140 is rotated and thereby the pinch roller 61, the second conveyance roller 62 and the platen 42 are moved downward as illustrated in FIG. 2.

Then, as illustrated in FIGS. 2 and 5A, the media tray 71 is inserted by the user of the multi-function device 10 in the direction of arrow 77, which is the direction opposite to the conveying direction, along the straight path 65B from the front opening 13 of the multi-function device 10. The media tray 71 being inserted is placed on the tray guide 76. When image recording on the recording medium placed on the media tray 71 is instructed by the manipulation on the manipulation panel 18, the first conveyance roller 60 and the second conveyance roller 62 are driven to rotate in the reverse direction.

When the media tray 71 inserted by the user is held by the second roller pair 59, the media tray 71 is separated from the user's hand and is conveyed in the direction opposite to the conveying direction, i.e., the direction of arrow 77 while being held by the second roller pair 59. The media tray 71 conveyed by the second roller pair 59 passes below the recording unit 24 and is held by the first roller pair 58 from the downstream of the conveying direction of the recording sheet.

At this time, since the media tray 71 does not reach the second path 66, the user of the multi-function device 10 can change positions of the lock portion 90 from the locked position to the unlocked position by manipulating the manipulation unit 100 in the direction of arrow 97 from the back surface of the multi-function device 10 as illustrated in FIGS. 8A to 8C. Then the user of the multi-function device 10 can move the cover member 80 from the closed position to the exposed position by pivotally moving the cover member 80 rearward as illustrated in FIG. 2. The reverse operation is also possible; positions of the cover member 80 can be changed from the exposed position to the closed position and positions of the lock portion 90 can be changed from the unlocked position to the locked position.

Then, as illustrated in FIGS. 2, 6, 7A and 7B, the media tray 71 held by the first roller pair 58 and the second roller pair 59 is guided further in the direction of arrow 77. With this, the recording medium placed on the media tray 71 is located in the upstream of the conveying direction of the recording sheet from the recording unit 24. Here, the media tray 71 protrudes outside the multi-function device 10 from the through hole 87 as illustrated in FIGS. 5B and 7B. At this time, since the media tray 71 is located on the second path 66 (see FIG. 8C), the user of the multi-function device 10 cannot manipulate the manipulation unit 100 to change positions of the lock portion.

In this state, a rotation direction of the first conveyance roller 60 and the second conveyance roller 62 is switched from the reverse rotation to the forward rotation. With this, the media tray 71 is conveyed in the direction opposite to the arrow 77, i.e., in the direction of the conveying direction of the recording sheet, and the recording medium placed on the media tray 71 is conveyed on the platen 42. The recording head 38 ejects ink droplets to the recording medium which is being conveyed on the platen 42. In this manner, an image is recorded on the disc surface of the recording medium. Then the media tray 71 is output to the outside of the multi-function device 10 from the front opening 13.

[Advantageous Effects of the Embodiment]

A compact multi-function device 10 has a first path 65 and a second path 66 which are short. It is therefore highly possible that, when the recording unit 24 is recording an image on the recording medium placed on the media tray 71 on the second path 66, a part of the media tray 71 lies on the second path 66. Here, in order for the user to manipulate the manipulation unit 100 to release the lock by the lock portion 90, it is necessary that at least a part of the lock portion 90 is located in the space which constitutes the second path 66. However, since the media tray 71 lies on the second path 66 as described above, the lock portion 90 cannot be located in the space which constitutes the second path 66. Therefore, the lock by the lock portion 90 cannot be released and thus the position of the cover member 80 is not changed from the closed position to the exposed position while an image is recorded on the recording medium. With this, damage to the media tray 71 and the recording medium placed on the media tray 71 can be reduced.

In the above-described embodiment, when the lock portion 90 is in its locked position, the lock portion 90 does not contact the media tray 71 and the recording medium placed on the media tray 71. It is therefore possible, for example, to reduce the lock portion 90 from applying frictional force to the media tray 71 guided along the second path 66. That is, it is possible to reduce the lock portion 90 from being load to the media tray 71 guided along the second path 66.

In the above-described embodiment, when the media tray 71 protrudes outside the multi-function device 10 from the through hole 87, the space which constitutes the through hole 87 is occupied by the tray. With this, it is not easy for the user to put, for example, the finger into the space and thus it is difficult to manipulate the manipulation unit 100. Since it is difficult to release the lock of the lock portion 90 while the media tray 71 protrudes outside the multi-function device 10 from the through hole 87, the possibility of the position change of the cover member 80 can be reduced.

First Modification

In the above-described embodiment, the configuration in which the manipulation unit 100 is provided in the lock portion 90 which is attached to the upper member 82 of the cover member 80 has been described. That is, the configuration in which the manipulation unit 100 is provided above the second path 66 and the through hole 87 has been described. However, the manipulation unit 100 may be provided below the second path 66 and the through hole 87. For example, in a first modification, it suffices that the manipulation unit 100 is provided in a space 89 which is symmetrical to the space 88 about a line 110 extending in the left-right direction 9 at the center of the height of the through hole 87 in the vertical direction 7 as illustrated in FIG. 7A. In this manner, a configuration of the first modification is implemented. A wall surface 89A is provided in the back of the space 89, i.e., on the front side of the space 89, in FIG. 7A; however, the wall surface 89A is provided in the above-described embodiment and is not provided in the first modification.

In the first modification, when the media tray 71 protrudes out of the multi-function device 10 from the through hole 87, the manipulation unit 100 is shielded by the media tray 71 and thus is not visible from above. Thus, it is difficult to manipulate the manipulation unit 100. Since it is difficult to release the lock of the lock portion 90 while the media tray 71 protrudes outside the multi-function device 10 from the through hole 87, the possibility of the position change of the cover member 80 can be reduced.

Second Modification

In a state in which the lock portion 90 is fit into the upper member 82, it is preferred that the positions of the two arms 92 of the lock portion 90 in the left-right direction 9 are outside the recording medium placed on the media tray 71 guided along the second path 66. With this, in the course of the position change of the lock portion 90 from the locked position to the unlocked position, the free ends of the two arms 92 of the lock portion 90 contact the upper surface 72 of the media tray 71 in areas A (see FIG. 3A) of the media tray 71 guided along the second path 66 in the width direction 74 of the media tray 71 (i.e., the left-right direction 9 when the media tray 71 is guided along the second path 66). That is, the free ends of the two arms 92 do not contact the upper surface 72 of the media tray 71 in an area B in which the recording medium is placed. As described above, the spaces corresponding to the areas A in the left-right direction 9 are examples of predetermined spaces among the spaces in which the media tray 71 guided along the second path 66 may lie.

In a second modification, the lock portion 90 may contact the media tray 71 but does not contact the recording medium placed on the media tray 71. It is therefore possible to reduce, for example, damage to the recording medium by the contact with the lock portion 90.

Third Modification

In the above-described embodiment, a configuration in which the lock portion 90 enters the space which constitutes the second path 66 from the side of the upper surface 72 of the media tray 71 guided along the second path 66 in the course of the position change from the locked position to the unlocked position as illustrated in FIGS. 8A to 8C has been described. However, a configuration in which the lock portion 90 enters the space which constitutes the second path 66 from the side of the lower surface 75 (see FIG. 3B) of the media tray 71 guided along the second path 66 in the course of the position change from the locked position to the unlocked position may also be possible.

In order to implement the configuration of the third modification, it suffices that, for example, the lock portion of the third modification is provided to be symmetrical to the lock portion 90 of the above-described embodiment about a line 120 extending in the front-rear direction 8 at the center of the height of the second path 66 in the vertical direction 7 as illustrated in FIG. 8A. In this case, the lock portion is provided in a space defined inside the lower member 83 which is, in particular, a space between the outer guide surface 83A and the rear plate 85. In this case, the manipulation unit 100 is visible from outside the multi-function device 10 via the space 89 (see FIG. 7A) described in the first modification. Thus, when the user of the multi-function device 10 manipulates the manipulation unit 100 downward in the space 89, the two arms 92 pivot upward. With this, the two arms 92 contact the lower surface 75 of the media tray 71 from below.

In the third modification, as in the second modification, the lock portion 90 may contact the media tray 71 but does not contact the recording medium placed on the media tray 71. It is therefore possible to reduce, for example, damage to the recording medium by the contact with the lock portion 90.

Fourth Modification

In the above-described embodiment, a configuration in which the through hole 87 is formed in the rear plate 85 of the cover member 80 has been described. However, it is not necessary to provide the through hole 87 as long as the second path 66 is long enough to convey the media tray 71 and there is no obstacle to the conveyance of the media tray 71 when an image is recorded on the recording medium. In particular, even if a leading end in the conveying direction of the media tray 71 which is being guided along the second path 66 (i.e., the direction of arrow 77, see FIG. 2) is positioned at the rearmost end, when the leading end is located further forward than a position at which the through hole 87 is provided, the media tray 71 does not protrude outside the multi-function device 10. Thus, it is not necessary to provide a through hole in the cover member, and it is enough to provide just a recess which can receive the tray.

Fifth Modification

In the above-described embodiment, the lock portion 90 in its locked position is located above the media tray 71 guided along the second path 66 and the recording medium placed on the media tray 71.

Nevertheless, the lock portion 90 in its locked position may be located in the same height as the upper surface of the media tray 71 guided along the second path 66 and the recording medium placed on the media tray 71. That is, the lock portion 90 in its locked position may be in contact with the media tray 71 guided along the second path 66 and the upper surface of the recording medium placed on the media tray 71.

What is claimed is:

1. An image recording device comprising:

a recording unit;

a feeding mechanism configured to feed a sheet from a first inlet via a position facing the recording unit along a feeding path and further configured to feed a tray, which is inserted from a second inlet, to the recording unit along a portion of the feeding path;

a guide member configured to guide at least the tray and movable between an extended position at which the guide member is extended outside the image recording device and a retracted position at which the guide member is retracted with respect to the image recording device; and a movement restriction portion configured to contact a contact portion of the tray, the movement restriction portion being configured to restrict movement of the guide member from the retracted position to the extended position when the movement restriction portion is contacting the contact portion, and configured to allow the guide member to move from the retracted position to the extended position when the movement restriction portion is not contacting the contact portion, wherein the guide member in the retracted position is configured to guide at least the tray to pass through the guide member such that the tray contacts the movement restriction portion to lock the guide member in the retracted position, and wherein the guide member is stationary relative to the tray as the tray passes through the guide member into the image recording device.

2. The image recording device according to claim 1, wherein the tray is configured to hold a recording medium thereon to carry the recording medium to the recording unit for recording.

3. The image recording device according to claim 2, wherein the recording medium is a CD-ROM or a DVD-ROM, and wherein the tray is configured to hold the CD-ROM or the DVD-ROM thereon to carry the CD-ROM or the DVD-ROM to the recording unit for printing.

4. The image recording device according to claim 1, wherein the guide member is pivotable.

5. The image recording device according to claim 1, wherein the movement restriction portion comprises a contacted portion which the tray contacts and a lock portion configured to lock the guide member, and wherein the lock portion is locking the guide member when the tray is contacting the contacted portion.

6. The image recording device according to claim 5, wherein the lock portion comprises a projection.

7. The image recording device according to claim 6, wherein the projection protrudes upward from the movement restriction portion.

8. The image recording device according to claim 6, further comprising a frame, wherein the projection is engaging with the frame when the tray is contacting the contacted portion.

9. The image recording device according to claim 2, wherein the movement restriction portion comprises an arm.

10. The image recording device according to claim 9, wherein the arm is configured to contact a portion, on which the recording medium is not placed, of the tray.

11. The image recording device according to claim 2, wherein the lock portion comprises a pair of arms.

12. The image recording device according to claim 11, wherein the pair of arms is configured to contact a portion, on which the recording medium is not placed, of the tray.

13. The image recording device according to claim 5, wherein the movement restriction portion is rotatable.

14. The image recording device according to claim 13, wherein one end of the movement restriction portion is the contacted portion and other end of the movement restriction portion is a rotating shaft.

15. The image recording device according to claim 1, wherein the movement restriction portion is arranged to contact the tray when the tray is fed to a predetermined position.

16. The image recording device according to claim 1, further comprising a manipulation unit configured to move the movement restriction portion.

* * * * *